US005462280A

United States Patent [19]

Dickerson

[11] Patent Number: 5,462,280

[45] Date of Patent: Oct. 31, 1995

[54] GOLF GRIP TRAINING DEVICE

[76] Inventor: Ralph T. Dickerson, 2994 Colorado Blvd., Denver, Colo. 80207

[21] Appl. No.: 325,615

[22] Filed: Oct. 19, 1994

[51] Int. Cl.[6] ..... A63B 69/36; A41D 19/00

[52] U.S. Cl. ..... 273/187.2; 2/161.2

[58] Field of Search ..... 273/187.5, 187.2, 273/166, 188 R; 2/161.1, 161.2, 161.3, 161.4

[56] References Cited

U.S. PATENT DOCUMENTS

| | | | |
|---|---|---|---|
| 1,915,617 | 6/1933 | Potter | 2/161.2 |
| 2,465,136 | 3/1949 | Troccoli | 273/166 X |
| 3,532,344 | 10/1970 | Masstab | 273/166 |
| 4,665,565 | 5/1987 | Odom | 273/166 X |
| 5,232,225 | 8/1993 | Snyder | 273/166 X |
| 5,253,367 | 10/1993 | Lappley | 273/166 X |

*Primary Examiner*—George J. Marlo

[57] ABSTRACT

A golf training device comprising a full golf glove used on the leading hand of the golf swing with a diagonal strip made of the same material as the glove but different color and sewn into the palm of said glove for the purpose of showing the exact placement of the golf club, and on the same glove of the leading hand, on the back of the thumb and running the length of the thumb, a strip of material carrying a plurality of hook like members; and on the other hand, a half glove, with fingers and thumb exposed is sewn a diagonal strip of felt like material; the two surfaces formed by the hook like members and felt like material being interlockingly engageable when matched up evenly in gripping a golf club, and showing the golf player the correct golf grip.

1 Claim, 3 Drawing Sheets

GOLF GRIP TRAINING DEVICE

BACKGROUND OF THE INVENTION

1. Field of the Invention

This invention relates in general to a training device for practicing golf skills, and in particular to a training device used to achieve the proper grip on a golf club.

2. Prior Art

The feel of the proper grip on the golf club is awkward, especially for the beginner and even some intermediate players. Shifting of the hands on the back swing or forward swing is common, thus changing your shot on the ball.

The Tredway U.S. Pat. No. 3,811,684 shows a golf swing training device wherein a golfer's glove supports and positions a light at the knuckle of the root of the forefinger of a golfer's hand so that when the golfer wears the glove and addresses a ball and then swings the club on the backswing properly, the rays of light from the light on the glove follows a prescribed path on an adjacent wall. However, the golf glove device of the Tredway Patent is awkward, if not unusable in outdoor situations.

The Bencriscutto U.S. Pat. No. 4,752,075 is a golf club grip training aid which can be considered either a band or glove which wraps around one hand of the golfer. It consists, in part, of a flexible loop secured to said band for receiving the thumb of players other hand, and a second flexible loop to receive the player's middle finger of the other hand. When both hands are gripping the golf club, the pull on either loop indicates that his grip is improper. The Bencriscutto Patent would be time consuming to put on, and awkward to remove after the golf swing.

The Churchill U.S. Pat. No. 4,643,428 is a golf club gripping aid that is a strap used in combination with a golf glove to maintain a golfer's hands in close relatively tight relation to each other when the golf club is gripped for hitting a golf ball. The thumb of the other hand is inserted into the loop of the strap. The Churchill Patent keeps hands snug, but does not insure the correct placement of the golf club in the gloved hand.

The OToole U.S. Pat. No 5,088,122 is a golf swing training glove. It consists of only one glove, using an elongated strap unit secured on one end to the top of the golf glove, with the other end of the strap member being of sufficient length to encircle the users fingers and the base of the thumb as well as the handle of the golf club. The OToole Patent would be cumbersome and time consuming on the golf course.

The Gauer U.S. Pat. No. 5,156,399 golf glove-supported golf swing aid is a combination of a golf glove adapted to be worn on the golf swing leading hand of said golfer, and a golf swing aid consisting of an elongated planar body extending from between two flaps of the golf glove, horizontally forward of the golfer and viewable by the golfer to in effect duplicate the position of the club head, serving as a visual guide to said golfer in making a proper golf swing. The Gauer Patent is primarily to improve the golf swing, rather than the golf grip.

The Lappley U.S. Pat. No. 5,253,367 golf glove enhances the grip by the use of a conventional golf glove with an elongated padded hump positioned adjacent the third and fourth fingers of the golf glove and aligned parallel with the base of the third and fourth fingers of the glove. The hump is formed of leather or other flexible sheet material into a pocket, and the pocket is filled with cotton batten or other non-woven compressible fibrous material. The hump being shaped and positioned such that it serves to enhance the grip of the hand against the golf grip, the overall effect being the glove urges the grip to remain adjacent the knuckles of the hand and enhances the gripping force of the third and fourth fingers, thereby urging a proper grip on the golf club. The Lappley Patent has no device for ensuring the player's other hand will not loose it's proper position during the golf swing.

SUMMARY OF THE INVENTION

The principle object of this invention is to provide a device for the use in training novice and intermediate golf players to achieve the perfect grip on the golf club. It is also the object of this invention to provide such a device which is of simple construction, easily worn and not cumbersome on the golf course. The foregoing objects are accomplished by adapting 2 conventional golf gloves (left and fight hand) using a diagonal color track across the palm of the leading hand to assure proper placement of the golf club, and having on the thumb of same glove, a surface carrying a plurality of small hook like members. While on the other glove (other hand) across the palm a surface carrying a felt like material, said surfaces engageable with each other. Thus shifting of hands or grip causes said engageable surfaces to make noise or to become disengaged, alerting the golfer of grip change during the golf swing.

DETAILED DESCRIPTION OF THE DRAWINGS

Figure 1:
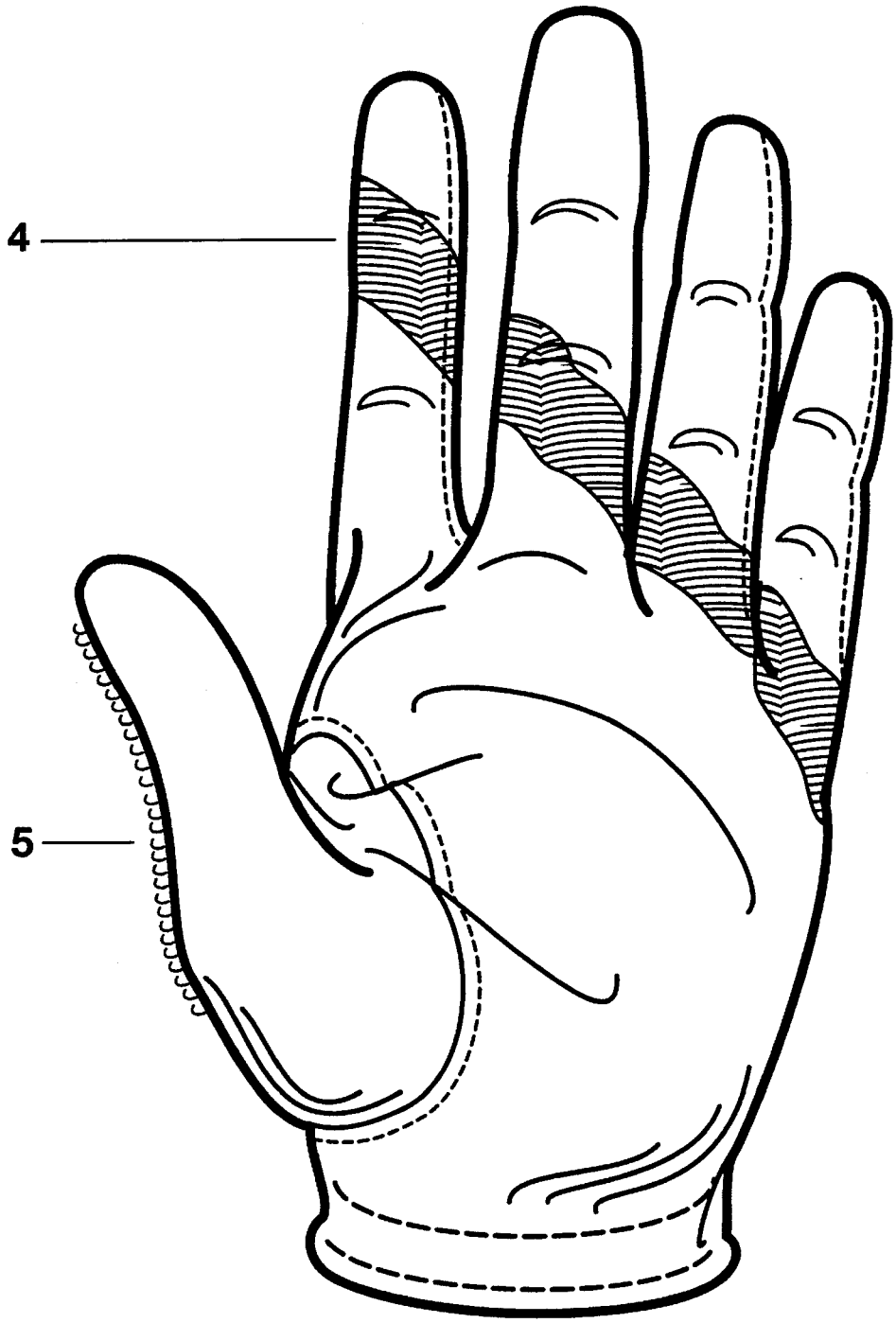
FIG. 1 is a side view of a full left handed glove with a strip running the length of the thumb.

FIG. 1 shows a full palm view of the left hand glove. This represents the leading hand in the golf swing. The diagonal strip (4) is made of the same material as the glove itself (usually a soft leather) but different color and is sewn into the palm side of the glove. The purpose of this tracking strip is to show the exact placement of the golf club.

Figure 2:
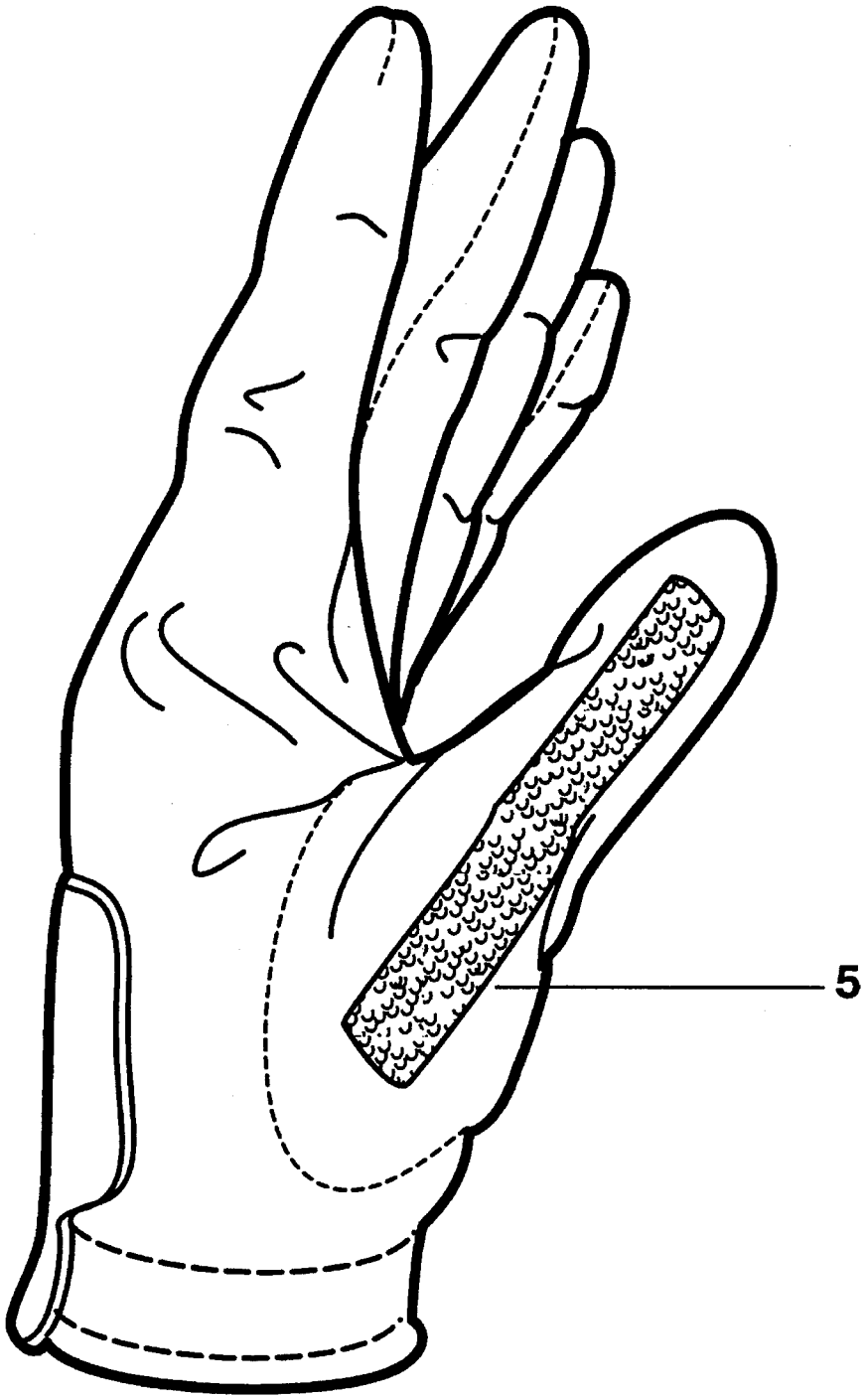
FIG. 2 is a palm up view of full left hand glove with diagonal strip across the palm.

FIG. 2 shows the side view of the same leading hand. On the back of the thumb and running the length of the thumb, is sewn a strip of material (5) carrying a plurality of hook like members.

Figure 3:
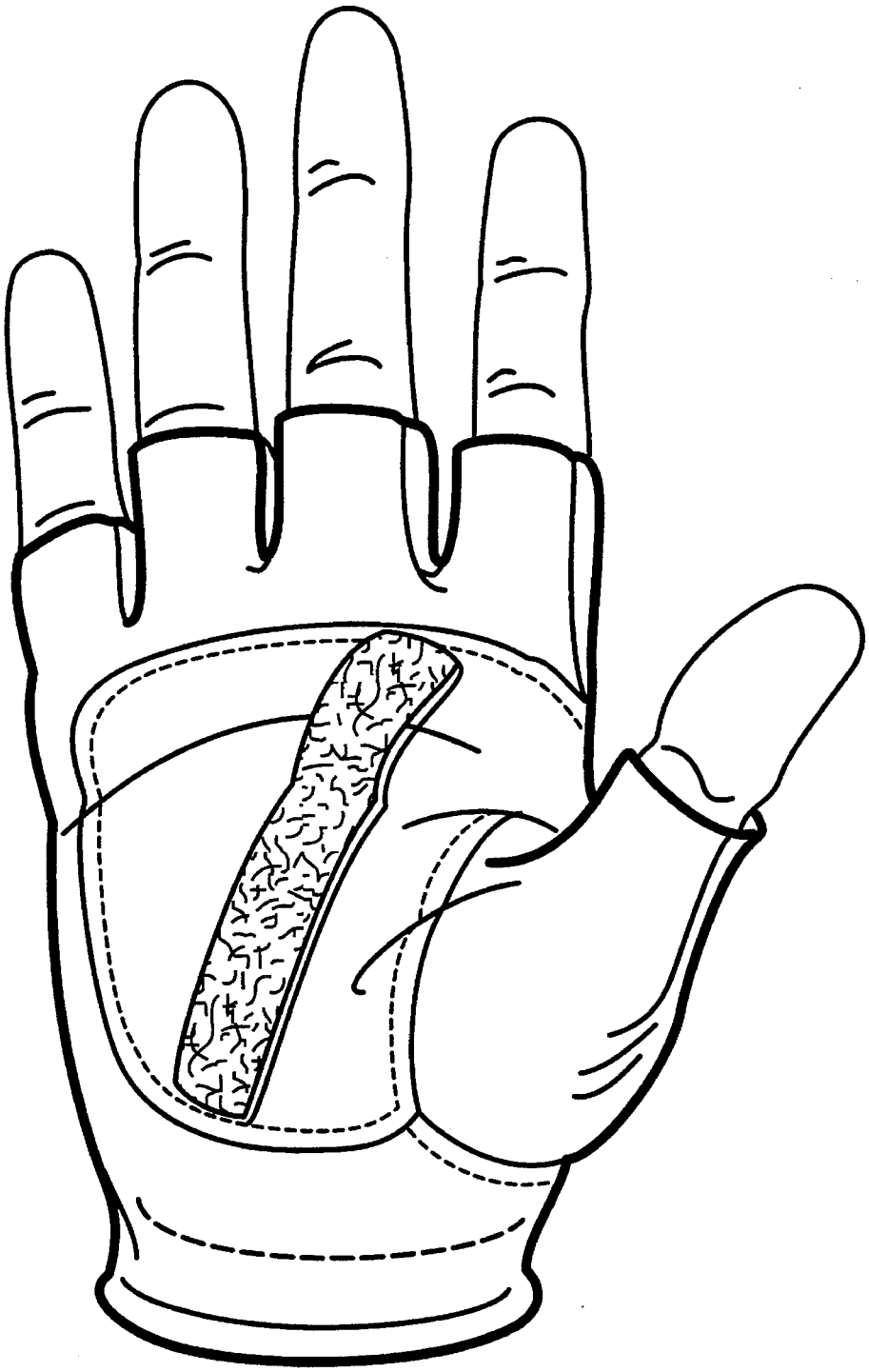
FIG. 3 is a half glove for fight hand with strip across the palm.

FIG. 3 On the half glove (right hand) with fingers and thumb exposed, is sewn a strip consisting of a felt like material (6). These two surfaces, 5 and 6 are engageable with each other when the strip on the right hand (felt like material) is placed directly over the strip on the left hand (hook like members) and the two strips are matched up evenly.

The above description is for a right handed golfer. The glove can be made for either a right handed person, or a left handed person.

The golf player would first align the golf club with the tracking strip (4), then place the thumb of same hand on the golf club shaft. The player would then place the half glove hand with the felt like material (6) directly over and matching evenly the hook like strip on the thumb of the leading hand.

I claim:

1. A golf training device comprising a full golf glove used on the leading hand of the golf swing with a diagonal strip made of the same material as the glove but different color and sewn into the palm of said glove for the purpose of showing the exact placement of the golf club, and on the same glove of the leading hand, on the back of the thumb and running the length of the thumb, a strip of material carrying a plurality of hook like members; and on the other hand, a half glove, with fingers and thumb exposed is sewn a diagonal strip of felt like material; the two surfaces formed by the hook like members and felt like material being interlockingly engageable when matched up evenly in gripping a golf club, and showing the golf player the correct golf grip.

* * * * *